United States Patent [19]

Kadija

[11] Patent Number: 4,482,440

[45] Date of Patent: Nov. 13, 1984

[54] ELECTROCHEMICAL CELL AND PROCESS FOR MANUFACTURING TEMPERATURE SENSITIVE SOLUTIONS

[75] Inventor: Igor V. Kadija, Cheshire, Conn.

[73] Assignee: Olin Corporation, New Haven, Conn.

[21] Appl. No.: 539,606

[22] Filed: Oct. 6, 1983

[51] Int. Cl.[3] ..... C25C 1/00; C25C 1/12; C25C 7/00

[52] U.S. Cl. ..... 204/105 R; 204/108; 204/130; 204/260; 204/262

[58] Field of Search ..... 204/260, 262, 130, 105 R, 204/108

[56] References Cited

U.S. PATENT DOCUMENTS

| | | | |
|---|---|---|---|
| 1,837,177 | 12/1931 | Baum | 204/262 |
| 2,224,831 | 12/1940 | Paul | 204/262 |
| 2,568,844 | 9/1951 | Benning et al. | 204/262 |
| 2,748,071 | 5/1956 | Eisler | 204/208 |
| 2,865,823 | 12/1958 | Harris et al. | 204/151 |
| 2,978,301 | 4/1961 | Margulies et al. | 41/42 |
| 3,406,108 | 10/1968 | Radimer et al. | 204/82 |
| 3,470,044 | 9/1969 | Radimer | 156/19 |
| 3,475,242 | 10/1969 | Radimer | 156/19 |
| 3,671,344 | 6/1972 | Chiang et al. | 156/19 |
| 3,761,369 | 9/1973 | Tirrell | 204/151 |
| 3,764,503 | 10/1973 | Lancy et al. | 204/180 P |
| 3,887,405 | 6/1975 | Fong et al. | 156/18 |
| 4,051,001 | 9/1977 | Inoue et al. | 204/130 |
| 4,144,144 | 3/1979 | Radimer et al. | 204/82 |
| 4,149,946 | 4/1979 | Burke | 204/180 |

FOREIGN PATENT DOCUMENTS

| | | | |
|---|---|---|---|
| 311502 | 4/1973 | U.S.S.R. | 204/262 |
| 470307 | 2/1976 | U.S.S.R. | 204/262 |

*Primary Examiner*—R. L. Andrews
*Attorney, Agent, or Firm*—Barry L. Kelmachter; Howard M. Cohn; Paul Weinstein

[57] ABSTRACT

An electrochemical cell for regenerating temperature sensitive solutions is described. In a preferred construction, the cell comprises a central electrode chamber and two counterelectrode chambers. To maintain the temperature of the electrolyte within a desired temperature range, the electrode in the electrode chamber is formed from at least one hollow tube through which a heat exchange medium flows. In a preferred construction, the electrode comprises a plurality of hollow tubes and a plurality of current collectors bonded to the tubes to form a grid-like structure.

23 Claims, 6 Drawing Figures

ELECTROCHEMICAL CELL AND PROCESS FOR MANUFACTURING TEMPERATURE SENSITIVE SOLUTIONS

This application is related to co-pending U.S. patent application Ser. No., 539,598, filed on an even date herewith, to Pryor et al. for PROCESS FOR CLEANING COPPER BASE MATERIALS AND REGENERATING THE CLEANING SOLUTION.

This invention relates to an electrochemical cell for regenerating a temperature sensitive solution.

The fundamental cleaning medium used in the copper industry is sulfuric acid at a strength from 10 to 15% by volume. The extensive use of sulfuric acid is based on the fact that for most brasses and high copper alloys, the annealing oxides are readily soluble in mineral acids. This produces very rapid oxide removal and the resulting cleaning process is, therefore, readily amenable to a short immersion time, continuous operation.

However, an increasing number of alloys now contain elements which can form insoluble, refractory type oxides. For these alloys, alternative cleaning procedures have been developed. These alternative cleaning procedures generally involve adding an oxidant such as sodium dichromate or hydrogen peroxide to the cleaning solution. While sodium dichromate has been used effectively for years, its use has been discontinued because of its known high toxicity and restrictions on waste treatment and discharge level. The use of hydrogen peroxide is limited by its inherent stability problems. The decomposition of hydrogen peroxide to water plus oxygen will occur during storage but is greatly accelerated by elevated temperatures and/or dissolved copper. These factors limit the maximum etching rates that can be obtained with hydrogen peroxide.

In response to these shortcomings and the need for an effective oxidizing cleaning solution, attention has turned to persulfate solutions. The use of persulfates is attractive for a copper cleaning operation because the end products of the reaction of persulfate with copper is sulfuric acid and copper sulfate. As such, no special waste water treatment is required. Furthermore, the depleted or spent persulfate solution may be regenerated and the copper in the depleted solution reclaimed. U.S. Pat. Nos. 3,475,242 to Radimer, 3,671,344 to Chiang et al. and 4,144,144 to Radimer et al. illustrate the use of aqueous persulfate solutions to etch copper.

The use of electrochemical cells to regenerate spent solutions and to reclaim metal values from the solutions are well known in the art. Typically, these cells have at least one anode chamber and at least one cathode chamber physically separated by a membrane. Depending upon the type of solution being regenerated and the chemical reactions sought to be produced, the membrane generally comprises either an ion exchange member or a microporous separator and the spent solution is used as either the anolyte or the catholyte. U.S. Pat. Nos. 2,748,071 to Eisler, 2,865,823 to Harris et al., 3,761,369 to Tirrell, 3,764,503 to Lancy et al., 4,051,001 to Inoue et al. and 4,149,946 to Burke illustrate some of the electrochemical cells used to regenerate spent cleaning solutions.

It has been suggested in the prior art to regenerate persulfate etchants using electrochemical cells. In one technique for regenerating a spent aqueous ammonium persulfate etchant, the spent etchant is treated to remove a substantially persulfate-free mixture containing ammonium sulfate and the corresponding metal sulfate. The substantially persulfate-free mixture is then transferred to the cathode chamber of an electrochemical cell where it is used as the catholyte. The remainder of the spent solution is transferred to the anode chamber of the cell where it is used as the anolyte. The cathode and anode chambers of the cell are separated by a diaphragm which permits at least hydrogen ions to pass freely between the anolyte and the catholyte but which prevents any substantial amounts of persulfate in the anolyte from mixing with the catholyte. By passing an electric current through the anolyte and the catholyte, metal is plated out at the cathode and persulfate values are produced at the anode. U.S. Pat. No. 3,406,108 to Radimer et al. illustrates this technique for regenerating spent persulfate etchants. The primary deficiency of this technique is its complexity which renders it commercially unacceptable.

A second and simpler technique is illustrated in U.S. Pat. No. 3,470,044 to Radimer. In this technique, the spent aqueous ammonium persulfate etching solution is used as the anolyte of an electrochemical cell. An electrolyte such as an acidic sulfate or a bisulfate containing electrolyte is used as the catholyte of the cell. The cathode and anode sections of the cell are separated by a cation exchange membrane which permits the dissolved metal ions to pass from the anolyte into the catholyte but which prevents any substantial amount of persulfate in the anolyte from mixing with the catholyte. By passing an electric current through the catholyte and the anolyte, dissolved metal is removed from the solution at the cathode and sulfate values are converted to persulfate values at the anode.

While simpler, this second technique is believed to be inefficient and commercially unacceptable. The production of temperature sensitive, oxidizing cleaning solutions such as persulfate etchants often require electrolyte temperatures to be maintained within certain critical limits during processing. Therefore, an electrochemical cell for regenerating such a temperature sensitive solution needs to have some means for controlling electrolyte temperature. Furthermore, special anodes are often required to improve cell efficiency. For example, a titanium-platinum anode such as that illustrated in U.S.S.R. Pat. No. 470,307 to Markov et al. may be used to improve current efficiency. Where cooling of the electrolyte is required, an internally cooled anode such as that illustrated in U.S.S.R. Pat. No. 311,502 to Markov et al. may be used.

In accordance with the present invention, a relatively simple but yet highly efficient electrochemical cell for regenerating temperature sensitive solutions is provided. The cell of the present invention may be used to regenerate a wide variety of solutions including but not limited to persulfuric acid, perchloric acid, perborates, sodium perchlorate, hydrogen peroxide, sodium persulfate, ammonium persulfate, potassium persulfate, cesium persulfate and rubidium persulfate.

The electrochemical cell of the present invention has means for controlling and maintaining a desired electrolyte temperature, means for providing a substantially uniform current distribution across the cell, means for separating the anolyte from the catholyte and means for minimizing IR drop in the electrolytes. In addition, the cell of the present invention may be used for both exothermic systems where cooling is required and endothermic systems where heating is required.

The cell of the present invention comprises at least one chamber containing an electrode and at least one chamber containing a counterelectrode. In a preferred construction, the cell has a central electrode chamber and two counterelectrode chambers, one on each side of the electrode chamber. To substantially avoid mixing of the products in the various cell chambers, a physical separator is located between each electrode and each counterelectrode. The physical separator may be either a diaphragm having a relatively fine porosity structure for allowing a restricted bulk flow from one chamber to another without any preference to the charge of the ions passing therethrough or an ion exchange membrane for permitting only the flow of ions of certain preferred charges between the chambers.

To control the temperature of the electrolytes in the cell within a desired range of temperatures, the electrode chamber of the cell is provided with means for heating or cooling the electrolyte. The heating/cooling means comprises at least one hollow tube through which a suitable heat exchange fluid passes. The tube or tubes form part of the electrode structure. Each tube is formed from an electrically conductive material which is also substantially corrosion resistant in the operating environment. Each tube is preferably formed from titanium or one of its alloys.

To provide the cell with a substantially uniform current distribution, the electrode further comprises at least one current collector bonded to each heating/cooling tube and at least one electrochemically active portion bonded to each tube preferably adjacent each current collector. In a preferred electrode construction, a plurality of spaced-apart current collectors are bonded to a plurality of heating/cooling tubes to form a grid-like structure. Each current collector preferably comprises a pair of metal or metal alloy strips contoured to fit about each tube and designed to minimize excessive overvoltage drop and power loss across the current collector. The size and the spacing of the current collectors depends upon the range of current density to be used in the cell and the operating electrode surface area. In a preferred construction, the current collector strips are formed from titanium or one of its alloys.

In a preferred construction, a plurality of electrochemically active portions are bonded to each tube adjacent to and between the spaced-apart current collectors. The electrochemically active portions comprise metal or metal alloy members such as metal or metal alloy rings spot welded to or inlayed in the heating-/cooling tubes. The extent of each electrochemically active portion depends upon the current density required in the cell. If needed, the electrochemically active portions could cover the total electrically conductive area exposed to the electrolyte. In a preferred embodiment, the electrochemically active portions are formed from bright recrystallized platinum. The use of platinum members is particularly advantageous where it is desired to have considerable overvoltages for the evolution of oxygen.

To further provide the cell with a substantially even current distribution, each counterelectrode is preferably formed from a metallic mesh-type structure. Each mesh-type counterelectrode preferably has an open area comprising at least about 50% of its surface area. In a most preferred construction, the open area comprises about 50% to about 70% of the counterelectrode surface area. This much open area insures good mass transport from the surrounding electrolyte to the operating electrode surface.

To minimize IR drop or losses in the electrolyte, particularly those due to electrolyte heating, the current path between each electrode and each counter-electrode is significantly reduced by using a narrow width cell construction having each electrode and counter-electrode in close proximity.

In a preferred cell construction, the chambers are arranged in a substantially vertical direction. By arranging the chambers in this fashion, the cell of the present invention may utilize bubble lift to promote electrolyte movement. The bubbles used to promote electrolyte movement are generally gaseous products formed at both the electrode and the counterelectrode.

While the cell of the present invention has wide applicability, it has been found to be particularly advantageous to regenerate a spent peroxydisulfuric acid solution used to clean copper or copper alloy strip material and to reclaim copper values from the spent solution. In such a peroxydisulfuric acid regeneration system, the spent solution will be transferred to the anode chamber where it will be used as the anolyte. An aqueous sulfuric acid solution is preferably used as the catholyte. By passing an electric current through the anolyte and the catholyte, copper will be deposited on each cathode, in this case the metallic mesh counterelectrodes, and persulfate values will be generated at the anode. To control and maintain the temperature of the regenerated solution, a suitable coolant such as a glycol solution is passed through the anode tubes.

It is an object of the present invention to provide a simple and efficient electrochemical cell for producing and/or regenerating temperature sensitive solutions.

It is a further object of the present invention to provide a cell as above for reclaiming metal values from the solutions.

It is yet a further object of the present invention to provide a cell as above for regenerating a spent peroxydisulfuric acid solution used to clean copper or copper alloy strip material and to reclaim copper from the spent solution.

These and further objects will become apparent from the following description and drawings in which like elements have been given like reference numbers.

An increasing number of copper alloys now contain elements which form insoluble refractory type oxides. As a result, some conventional cleaning or etching solutions have had to be replaced by oxidizing cleaning solutions such as hydrogen peroxide and ammonium persulfate. The use of these oxidizing solutions, however, has created certain additional problems. One of these problems has to do with the inherent stability of some oxidizing cleaning solutions, e.g. decomposition at elevated temperatures. To obviate this problem, it often becomes necessary to maintain the temperature of the solution during processing and/or use within certain temperature limits. Another problem has to do with the reality that it is no longer economically justifiable to immediately discard and replace spent solutions. Therefore, it becomes necessary to find some mechanism for regenerating the spent solution.

In accordance with the present invention, an improved electrochemical cell for regenerating spent cleaning solutions is provided. The electrochemical cell of the present invention has particular utility in regenerating temperature sensitive solutions such as oxidizing cleaning solutions. As used herein, the term "cleaning solution" is synonymous with the terms "pickling solution" and "etchant".

Figure 1:
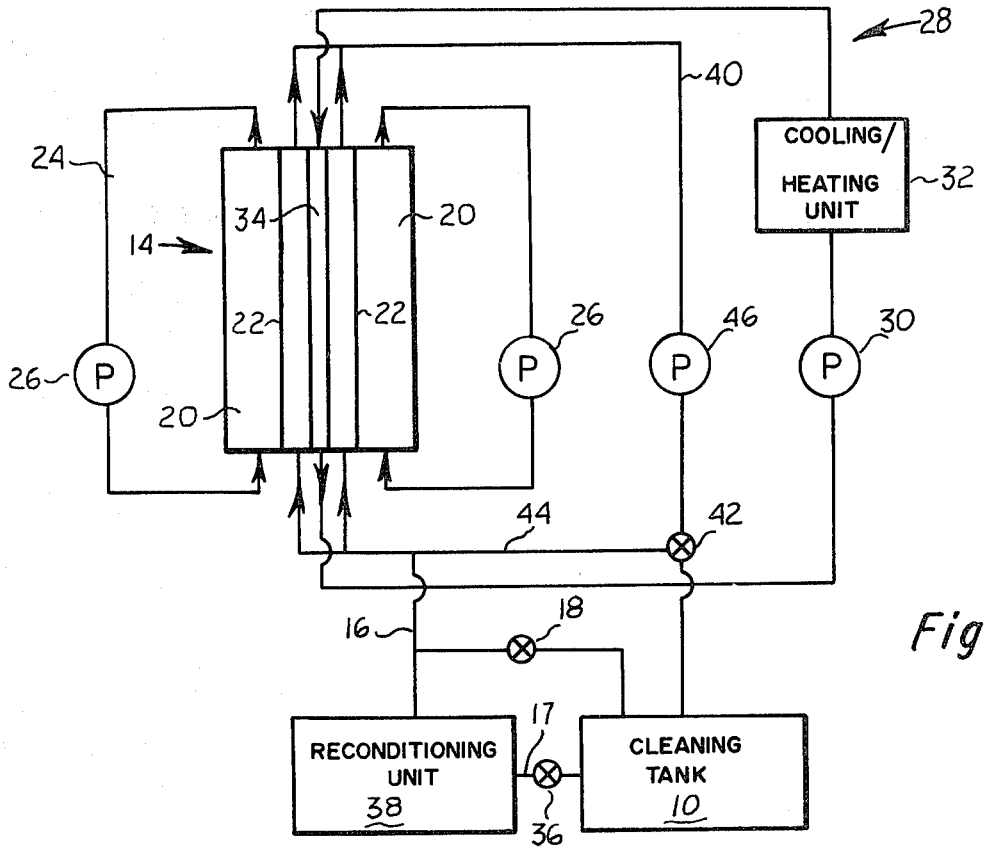
FIG. 1 is a schematic representation of a system for cleaning metal strip incorporating the electrochemical cell of the present invention.

Referring now to FIG. 1, a system for cleaning metal or metal alloy strip such as copper or copper alloy strip is illustrated. The metal or metal alloy strip not shown to be cleaned is passed through a cleaning tank 10 containing a cleaning solution. The type of cleaning solution depends upon the material forming the strip to be cleaned and the nature of the contaminants to be removed. Depending upon the cleaning solution used, the strip may be cleaned either by chemical action alone or by chemical action in combination with mechanical action. Any suitable cleaning technique known in the art may be used to clean the metal strip.

Figure 2:
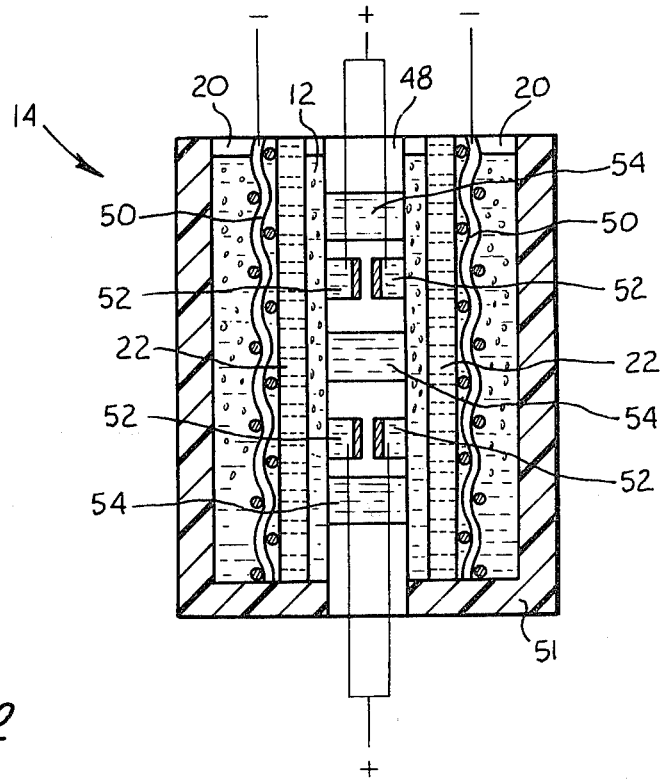
FIG. 2 is a side view of the cell of the present invention in partial cross section.

Incorporated into the system of FIG. 1 is an electrochemical cell 14 for regenerating the cleaning solution after its cleaning power has been depleted and its cleaning rate is no longer commercially acceptable. The spent solution may be withdrawn from the cleaning tank 10 and transferred via flow line 16 and valve 18 to a chamber 12 of the electrochemical cell 14. As shown in FIG. 2, the chamber 12 has an electrode 48 to be described in more detail hereinafter and the spent solution is used as the electrolyte in chamber 12.

The electrochemical cell 14 also has at least one chamber 20 containing a counterelectrode 50. In a preferred cell construction, the electrode chamber 12 is located in the central portion of the cell and is flanked on two sides by counterelectrode chambers 20. A physical separator 22 separates the electrode chamber 12 from each counterelectrode chamber 20.

A suitable counterelectrolyte is supplied to and circulated through each counterelectrode chamber 20 by a counterelectrolyte circulation loop 24. Each counterelectrolyte circulation loop 24 has a pump 26 to circulate the counterelectrolyte. Circulating the counterelectrolyte is desirable to help the efficiency of the system, particularly the system's cooling efficiency. If needed, each loop 24 may also have additional means not shown for cooling or heating the counterelectrolyte prior to its entry into each counterelectrode chamber 20. For reasons to be discussed hereinafter, it is preferred to flow the counterelectrolyte through the chamber 20 in the same direction that the electrolyte flows through the chamber 12.

To maintain the temperature of the electrolyte within certain desired limits, a heat exchange medium or fluid is circulated through the electrode chamber 12. The heat exchange medium may comprise any suitable heat exchange fluid known in the art and is circulated through the chamber 12 by heat exchange loop 28. Heat exchange loop 28 comprises a pump 30 for circulating the heat exchange medium, a unit 32 for either cooling or heating the heat exchange medium, and at least one hollow fluid conduit 34 extending through the chamber 12. The heat exchange medium preferably flows through the heat exchange loop 28 so that the fluid in each conduit 34 travels in a direction counter to the flow direction of the electrolyte in the chamber 12.

If adjustments in raw material concentration, solution temperature or other parameters are needed prior to solution regeneration, the spent solution may be first transferred from the cleaning tank 10 to a reconditioning unit 38. To do this, the spent solution is withdrawn from the tank 10 via line 17 and valve 36 in lieu of line 16 and valve 18. The reconditioning unit 38 may comprise any suitable solution reconditioning means known in the art. Of course, the type of reconditioning unit utilized depends upon the type of adjustment that needs to be made to the spent solution. For example, reconditioning unit 38 may comprise means for heating or cooling the spent solution or means for adding one or more raw materials and mixing them into the spent solution. After the spent solution has been reconditioned, it may be transferred to the chamber 12 via flow line 16.

After the spent solution has been regenerated in the cell 14, it is returned to the cleaning tank 10 through the flow line 40. A valve 42 is provided in flow line 40 to permit recirculation of the solution to the electrode chamber 12 via flow line 44 if desired or if needed. To facilitate circulation of the cleaning solution, a pump 46 may be incorporated into the flow line 40. If desired, a storage tank not shown for holding the regenerated cleaning solution until it is needed may be incorporated into the flow line 40.

Pumps 26, 30 and 46 may be any suitable pump known in the art. Similarly, valves 18, 36 and 42 may be any conventional valve known in the art.

Figure 3:
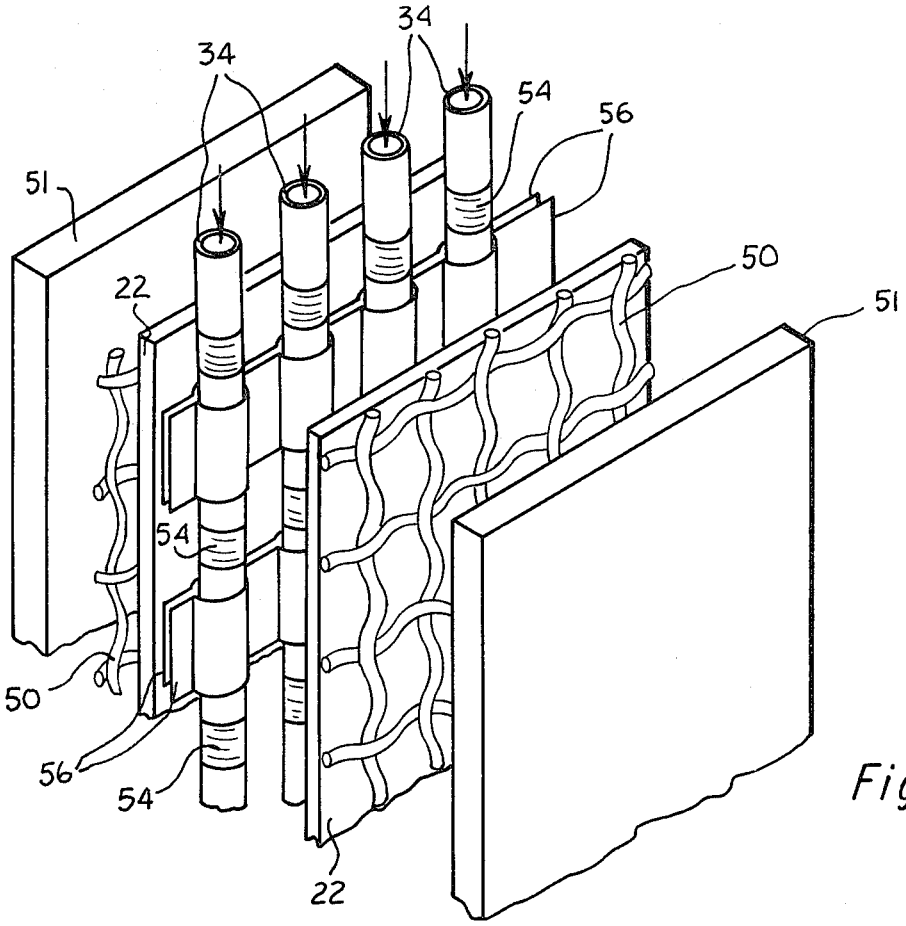
FIG. 3 is an exploded view of the components of the electrochemical cell of FIG. 2.
Figure 4:
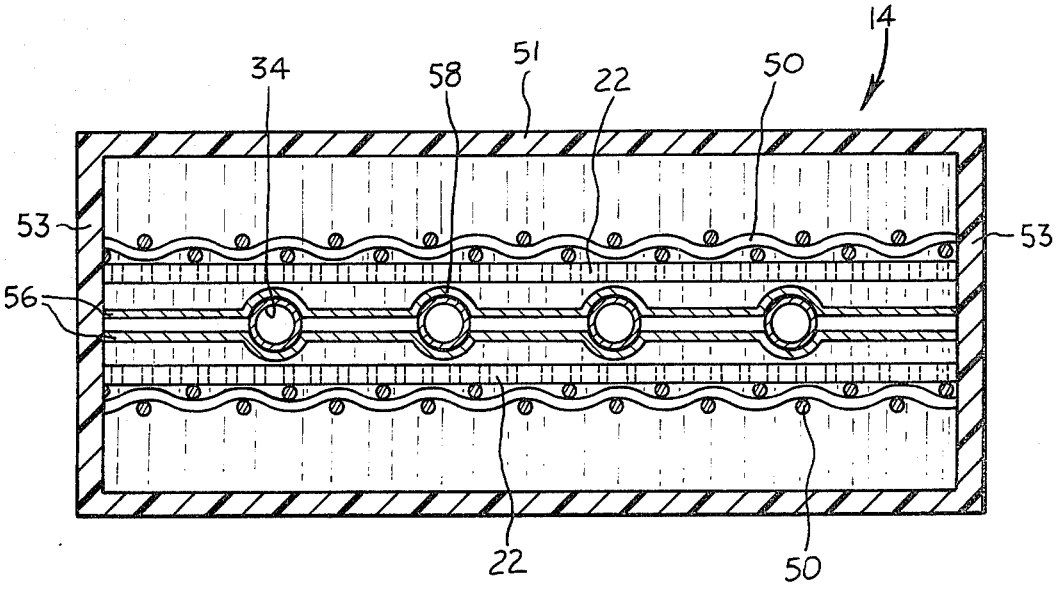
FIG. 4 is a top view in partial cross section of the electrochemical cell of FIG. 2.

Referring now to FIGS. 2–4, the electrochemical cell 14 is illustrated in more detail. As previously described, the cell 14 preferably has a central electrode chamber 12 and two counterelectrode chambers 20. The extent of the electrode chamber 12 is defined by the placement of the physical separators 22. Preferably, the separators 22 are located in close proximity to the electrode 48. The extent of each counterelectrode chamber 20 is defined by one of the physical separators 22 and a respective cell wall 51. The cell walls 51 may be formed from any suitable material known in the art. The cell walls may be formed from an electrically non-conductive material or from a suitable metallic material.

The physical separators 22 are used to substantially prevent mixing of the products in the electrode and counterelectrode chambers 12 and 20, respectively. The physical separators 22 may be mounted in the cell in any suitable manner. For example, notches not shown for receiving the separators may be cut into each cell wall 53 and suitable packing means not shown may be placed around the edges of the separators to form a fluid seal between the notches and the respective separators. Each physical separator 22 is preferably formed from a material resistant to attack by the electrolyte and the counterelectrolyte and may be either a diaphragm such as a microporous polyethylene diaphragm or an ion exchange membrane such as a Nafion or a cation exchange member. A diaphragm would be used where it is desired to have a restricted bulk flow from one chamber to another without any preference to the charge of the ions passing through it. Preferably, a diaphragm having a fine porosity structure would be used. An ion exchange membrane would be used where it is desired to substantially prevent any bulk flow but to permit the flow of ions of certain preferred charges. If desired, each physical separator could comprise either a diaphragm or a membrane and inert plastic meshes.

The electrode 48 in the chamber 12 is the most complex structure in the cell of the present invention because of the variety of roles that it plays during cell operation. At a bare minimum, the electrode 48 comprises at least one hollow tube or conduit through which the heat exchange medium flows, at least one current collector 52 bonded to the at least one tube, and at least one electrochemically active portion 54 bonded to the at least one tube. In a preferred construction, the electrode 48 comprises a grid-like structure formed by a plurality of spaced-apart substantially parallel tubes 34, a plurality of spaced-apart substantially parallel current collectors 52 arranged substantially transverse to said tubes 34, and a plurality of electrochemically active portions 54 located on each tube 34 preferably substantially adjacent to and between the location where each current collector 52 is bonded to each tube 34. The electrode 48 may be mounted in the chamber 12 in any suitable manner using any suitable means known in the art.

Each of the tubes 34 is formed from an electrically conductive material which is substantially corrosion resistant in the operating environment. While any electrically conductive material having suitable corrosion resistance characteristics may be used, titanium or one of its alloys is a preferred material for the tubes 34.

It is important to the efficient operation of the cell of the present invention to minimize the volume of the electrode chamber 12. It has been found that by minimizing the electrode chamber volume it is possible to obtain better control of the electrolyte temperature and increase product output of the cell. The primary limitation on electrode chamber size is the diameter of each tube 34. The diameter of each tube is a function of the electrolyte resistance and the operating overvoltage needed to insure a substantially even current distribution. It has been found that a preferred diameter for the heat exchange tubes is in the range of about 1 mm. to about 30 mm. and a most preferred diameter is in the range of about 3 mm. to about 7 mm.

The wall thickness of the tubes 34 is another important factor in the efficient operation of the cell 14. The wall thickness for each tube should be such that adequate mechanical stability and good heat conduction are provided. It has been found that a wall thickness in the range of about 0.2 mm. to about 0.5 mm. should provide the desired effects.

The current collectors 52 bonded to the tubes 34 preferably each comprise a pair of spaced-apart strips 56 of electrically conductive material. While the strips 56 may have any desired shape, it is desirable to contour each strip 56 to form good contacts with the tubes 34. In the cell of the present invention, each strip 56 preferably has a substantially semicircular portion 58 where it contacts each tube 34.

To promote a substantially uniform current distribution throughout the cell, the current collectors 52 are substantially uniformly distributed over the length of the tubes 34. The number, the spacing and the size of the current collectors 52 depend upon the range of current density to be used in the cell and the operating electrode surface area. It is desirable to design each current collector 52 to minimize the excessive overvoltage drop and the resultant power loss across the current collectors. It has been found that satisfactory operation of the cell can be obtained by spacing the current collectors 52 from about 1 cm. to about 5 cm. apart, preferably from about 2 cm. to about 3 cm. apart and by providing each strip 56 with a substantially rectangular cross section having a width in the range of about 0.5 cm. to about 3 cm. and thickness in the range of about 0.02 cm. to about 0.04 cm.

While any suitable metal or metal alloy may be used to form the current collectors 52, titanium or one of its alloys is a preferred material. The material selected for the current collectors 52 should also have good corrosion resistance properties.

The strips 56 may be joined to the tubes 34 in any suitable manner known in the art. Preferably, each strip 56 is spot welded to each tube 34.

The electrochemically active portions 54 are preferably formed by metal members bonded to the tubes 34. While any suitable member providing the necessary surface area may be used, it is preferred to form the portions 54 by spot welding a plurality of rings 54 to the tubes 34. In lieu of spot welding the rings 54 to the tubes 34, the rings 54 could be inlayed into the tubes 34.

The extent of the portions 54 on each tube 34 and the surface area needed for each portion depend upon the current density sought to be used in the cell. If needed, the portions 54 could cover the total electrically conductive area of the electrode 48 exposed to the electrolyte. It has been found that the surface area of each portion 54 should be in the range of about 2 $cm^2$ to about 3.5 $cm^2$.

The thickness of the portions 54 should be such that the portions 54 have sufficient strength to be durable and economically acceptable. The thickness of the portions should preferably be in the range of about 10 microns to about 50 microns and most preferably in the range of about 15 microns to about 25 microns.

While the electrochemically active portions 54 may be formed from any suitable metal or metal alloy, it is preferred to form them from platinum or one of its alloys because platinum forms oxides which slow down any oxygen evolution at the electrode 48 and introduces the overvoltages needed for most reactions. In a most preferred construction, the portions 54 are formed from bright recrystallized platinum.

It is important to the efficient operation of the cell 14 that the spacing between the electrode 48 and each counterelectrode 50 be minimized. By minimizing the spacing between the electrode 48 and each counterelectrode 50, the current paths through the electrolyte and the counterelectrolyte are minimized and the $I^2R$ losses are greatly reduced. Therefore, each counterelectrode 50 should be designed to have sufficient stiffness that it may be placed in close proximity to the separator 22. Each counterelectrode 50 should also be designed to promote substantially even current distribution throughout the cell 14.

In a preferred embodiment, each counterelectrode 50 is formed from a metallic mesh type structure having at least about 50% of its surface area open. The at least about 50% open area insures good mass transport from the surrounding counterelectrolyte and promotes better usage of the separator 22 because more of its surface area is exposed to the counterelectrolyte. In a most preferred embodiment, the open area is from about 50% to about 70% of the counterelectrode surface area.

Depending upon the metal or metal alloy chosen for each counterelectrode and its resilience, each counterelectrode 50 should have a thickness in the range of about 0.5 mm. to about 5 mm. and preferably in the range of about 0.7 mm. to about 1.5 mm. Preferably, the counterelectrodes are formed from copper or one of its alloys. For example, each counterelectrode may be a brass screen formed by 0.062" diameter wires and having about 64% open area.

The counterelectrodes 50 may be mounted in the chambers 20 in any suitable manner using any suitable means known in the art. However, it is important during use of the cell that the counterelectrodes be maintained in position and not have hydrostatic pressure from the electrolyte move them away from the electrode. If desired, polyvinylchloride standoffs not shown may be mounted on the outside wall of each counterelectrode chamber to prevent such an occurrence.

In some systems, each counterelectrode 50 functions as a cathode. In those systems, metal from the electrolyte may be deposited on the counterelectrodes 50. If needed, removal of the deposited metal may be done in either a batchwise or a continuous manner.

Figure 5:
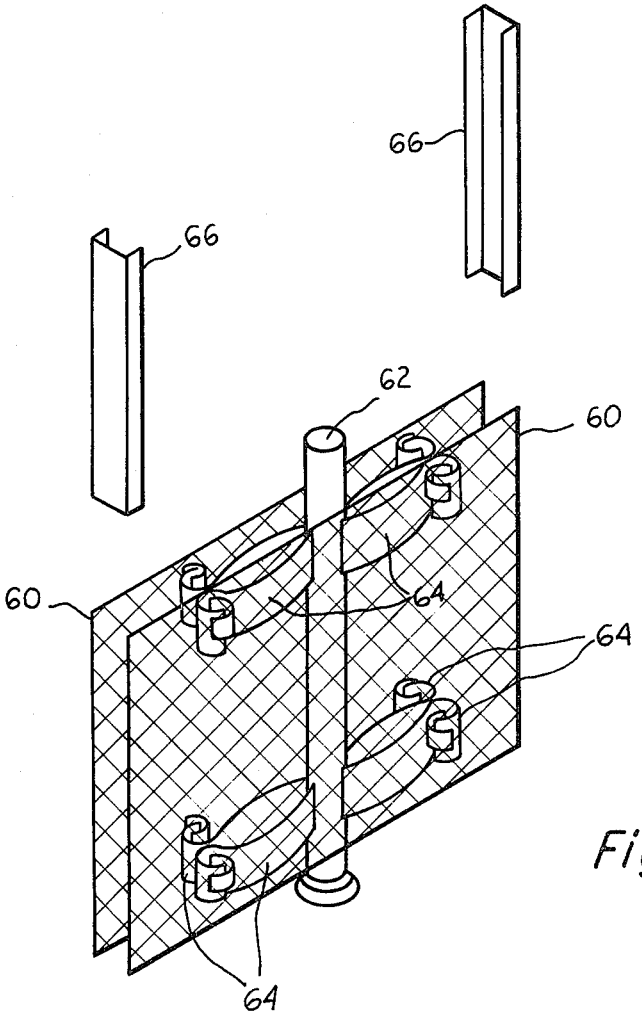
FIG. 5 is an exploded view of an alternative cathode construction suitable for use in the electrochemical cell of FIG. 2.

Referring now to FIG. 5, a counterelectrode assembly suitable for use in a batchwise removal system is illustrated. The counterelectrode comprises a pair of metallic mesh members 60 elastically attached to a current collector post 62 by spring current collectors 64. During insertion or removal of the counterelectrode assembly, the spring current collectors may be held in a retracted position by clamps 66. Clamps 66 may comprise any suitable clamping devices known in the art.

Figure 6:
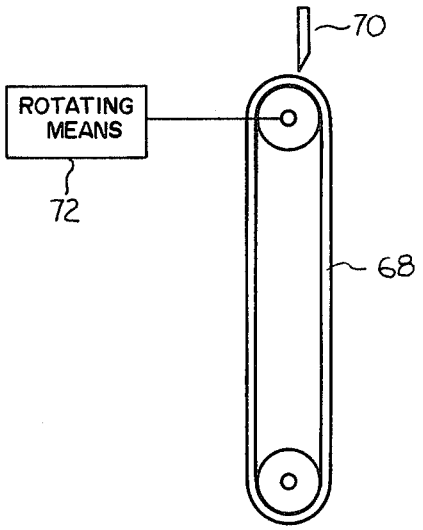
FIG. 6 is an illustration of yet another cathode construction suitable for use in the cell of FIG. 2.

If a continuous removal system is desired, a counterelectrode assembly such as that shown in FIG. 6 may be used. In this assembly, the counterelectrode is formed from an endless metallic mesh belt 68 rotated by drive means 72. Drive means 72 may comprise any suitable drive arrangement such as a motor and gear arrangement known in the art. Suitable means 70 for removing the deposited metal from the belt 68 may be provided adjacent one of the belt surfaces. The metal removing means 70 may comprise any suitable scrapping or scrubbing device known in the art.

In operation, the electrode 48 and the counterelectrodes 50 are connected to a suitable current source not shown. Preferably, the electrode 48 is connected to the curent source via one or more copper busses not shown attached to the current collectors 52. The current source may be any conventional power supply known in the art.

In a preferred manner of using the cell 14, the cell is arranged so that the electrolyte and the counterelectrolyte both flow substantially upwardly. By flowing the electrolyte and counterelectrolyte through the cell in such a manner, it is possible to take advantage of any bubble lifting effect created in the chambers 12 and 20. The bubble lifting effect results from gas bubbles being created at the electrode 48 and the counterelectrodes 50. The gas bubbles rise in the chambers 12 and 20 and promote movement of the electrolyte and the counterelectrolyte. To achieve the benefits of this effect, it is desirable to orient the cell 14 so the chambers 12 and 20 have their longitudinal dimensions in a substantially vertical plane.

It has been discovered that the electrochemical cell of the present invention has particular utility in regenerating peroxydisulfuric acid and persulfate solutions used to clean copper and copper alloy materials. In a peroxydisulfuric acid or persulfate solution regeneration system, the electrode 48 would be connected as the anode and the counterelectrodes 50 would be connected as the cathodes. The anode 48 preferably comprise thin sheets of platinum foil spot welded to thin titanium tubes. A substantially uniform current density can be provided by connecting the anode tubes to copper busses with a series of thin titanium strips. Spot welding may be used to attach the current collector strips to the anode tubes. The cathodes may comprise brass screens formed from 0.062" diameter wires having a 64% open area. The physical separators between the anode 48 and each of the cathodes 50 preferably comprise microporous polyethylene diaphragms which act as a diffusion barrier between the anolyte and the catholyte but which also allow some interdiffusion between the chambers 12 and 20.

The spent peroxydisulfuric acid or persulfate cleaning solution is used as the anolyte in the chamber 12. The catholyte may comprise an aqueous sulfuric acid solution. To maintain the temperature of the anolyte within a desired temperature range, a refrigerated glycol solution may be circulated through the tubes 34 to remove heat from the cell. The anolyte should be reasonably chilled to prevent decay as the result of increasing temperature during the regeneration process. In addition, the heat buildup in the anolyte needs to be controlled to favor production of persulfate as opposed to production of peroxide.

By applying an appropriate current to the cell, copper values in the spent cleaning solution will be plated out at the cathodes while persulfate values are being generated at the anode. The removal of the copper values from the spent solution and the production of new persulfate values increases the cleaning power of the spent solution and permits it to be reused. After a commercially acceptable level of cleaning power has been restored to the peroxydisulfuric acid or persulfate solution, the solution is withdrawn from the anode chamber and either supplied to a cleaning tank for cleaning metal or metal alloy strip or to a storage tank for later use. The process for regenerating and/or producing peroxydisulfuric acid using sulfuric acid catholyte is more fully described in co-pending U.S. patent application Ser. No. 539,598, filed on an even date herewith, to Pryor et al. which is hereby incorporated by reference.

While the electrochemical cell of the present invention has been described as having particular utility in regenerating peroxydisulfuric or persulfate cleaning solutions, it also may be used to regenerate and/or produce other temperature sensitive solutions such as hydrogen peroxide, perchloric acid, sodium perchlorate and perborates.

While the cell has been shown as having a central electrode and a pair of counterelectrodes, it may be designed to have more than one electrode and more than two counterelectrodes.

While the counterelectrodes have been described as being formed from metallic mesh screens, they may be formed from other types of metallic materials having the desired open area.

The U.S. patents, the U.S. patent application and the foreign patent publications set forth in the specification are intended to be incorporated by reference herein.

It is apparent that there has been provided in accordance with this invention an electrochemical cell for regenerating temperature sensitive solutions which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A process for regenerating a spent temperature sensitive solution, said process comprising:

providing an electrochemical cell having at least one chamber containing an electrode and at least one other chamber containing a counterelectrode and a counterelectrolyte;

supplying said spent solution to said at least one electrode chamber for use as an electrolyte;

maintaining the temperature of said electrolyte during solution regeneration within a desired temperature range to reduce the rate of decay of said temperature sensitive solution, said maintaining step comprising forming each said electrode from a plurality of spaced apart, substantially parallel hollow tubes and flowing a heat exchange medium through each said tube; and distributing a substantially uniform current through said cell, said current distributing step comprising applying said current to a plurality of spaced apart, substantially parallel current collectors bonded to external surfaces of said tubes.

2. The process of claim 1 wherein said heat exchange medium flowing step comprises:

flowing a coolant through each said tube for removing heat from said electrolyte.

3. The process of claim 1 wherein said heat exchange medium flowing step comprises:

flowing a heated solution through each said tube to raise the temperature of said electrolyte.

4. The process of claim 1 further comprising:

circulating said electrolyte and said counterelectrolyte through said cell in a first direction; and flowing said heat exchange medium through said tubes in a direction opposed to said first direction.

5. The process of claim 1 further comprising:

placing each said electrode in close proximity to said at least one counterelectrode to minimize the current path and thereby reduce $I^2R$ losses.

6. The process of claim 1 further comprising:

reclaiming metal values from said spent solution by plating said metal values onto at least one of said electrode and counterelectrode, whereby reclaiming said metal values increases the cleaning power of said solution.

7. The process of claim 1 further comprising:

passing a restricted bulk flow from one of said chambers to another of said chambers without any preference to the charge of any ions in said electrolyte and said counterelectrolyte, said passing step comprising placing at least one diaphragm having a fine porosity structure between said at least one electrode chamber and said at least one counterelectrode chamber.

8. The process of claim 1 further comprising:

passing a flow of ions of preferred charges between said chambers while substantially preventing any bulk flow, said passing step comprising placing at least one ion exchange member between said at least one electrode chamber and said at least one counterelectrode chamber.

9. An electrochemical cell for regenerating a temperature sensitive solution, said cell comprising:

at least one chamber containing an electrode and an electrolyte, said electrolyte comprising said temperature sensitive solution;

at least one additional chamber containing at least one counterelectrode; and means for separating said at least one electrode chamber from each said counterelectrode chamber, wherein the improvement comprises:

each said electrode comprising a plurality of spaced apart, substantially parallel hollow tubes and a plurality of spaced apart, substantially parallel electrical conductors bonded to an external surface of each said tube and being arranged substantially transverse to the longitudinal dimension of said hollow tubes to form a grid-like structure; and a heat exchange medium flowing through each said hollow tube for maintaining the temperature of said electrolyte in a desired temperature range, whereby said grid-like electrode structure promotes better temperature control and substantially uniform current distribution in said cell.

10. The cell of claim 9 wherein said heat exchange medium comprises means for cooling said electrolyte and for removing heat from said cell.

11. The cell of claim 9 wherein said heat exchange medium comprises means for supplying heat to said electrolyte for promoting a chemical reaction at said electrode.

12. The cell of claim 9 wherein each said electrode further comprises:

at least one electrochemically active portion bonded to said external surface of each said hollow tube.

13. The cell of claim 12 wherein each said electrode further comprises:

a plurality of electrochemically active portions bonded to the external surfaces of said hollow tubes, said portions being located adjacent to and between said spaced apart electrical conductors.

14. The cell of claim 13 wherein each said electrical conductor comprises a pair of metallic strips bonded to said external surface of each said hollow tube, each said metal strip having at least one portion contoured to fit about each said tube.

15. The cell of claim 14 further comprising said electrical conductor strips being substantially uniformly spaced along the length of each said hollow tube and being formed from titanium or one of its alloys.

16. The cell of claim 13 wherein said electrochemically active portions comprise:

a plurality of rings spot welded tubes; each said ring being formed from platinum or one of its alloys and having a surface area in the range of about 2 $cm.^2$ to about 3.5 $cm.^2$ and a thickness in the range of about 10 to about 50 microns.

17. The cell of claim 13 further comprising:

each said hollow tube being formed from titanium or one of its alloys and having a diameter in the range of about 1 mm. to about 30 mm. and a wall thickness in the range of about 0.2 mm. to about 0.5 mm.

18. The cell of claim 9 wherein each said counterelectrode comprises:

a metallic mesh having about 50% to about 70% of its surface area open.

19. The cell of claim 18 further comprising:

each said metallic mesh counterelectrode having a thickness in the range of about 0.5 mm. to about 5 mm.

20. The cell of claim 9 further comprising:

each said counterelectrode chamber containing a counterelectrolyte; and each said separating means comprising a diaphragm having a relatively fine porosity structure for restricting bulk flow of said electrolyte and said counterelectrolyte between said chambers.

21. The cell of claim 9 further comprising:

each said counterelectrode chamber containing a counterelectrolyte; and each said separating means comprising an ion selective membrane for permitting selected ions from said electrolyte and said counterelectrolyte to pass between said chambers.

22. The cell of claim 9 further comprising:

a single electrode chamber located centrally in said cell; and two counterelectrode chambers within said cell, said counterelectrode chambers being positioned on opposed sides of said electrode chamber.

23. The cell of claim 9 further comprising:

each said counterelectrode being in relatively close proximity to each said electrode to minimize the current path between each said counterelectrode and each said electrode and to minimize internal $I^2R$ heat losses.

* * * * *